US010301145B2

(12) United States Patent
Bing-Wo

(10) Patent No.: US 10,301,145 B2
(45) Date of Patent: May 28, 2019

(54) PROCESS FOR DRAFT CONTROL ON FEEDING OF ELASTIC YARN

(71) Applicant: Ronald D. Bing-Wo, Waynesboro, VA (US)

(72) Inventor: Ronald D. Bing-Wo, Waynesboro, VA (US)

(73) Assignee: INVISTA North America S.ar.l., Wilmington, DE (US)

( * ) Notice: Subject to any disclaimer, the term of this patent is extended or adjusted under 35 U.S.C. 154(b) by 768 days.

(21) Appl. No.: 14/782,153

(22) PCT Filed: Apr. 2, 2014

(86) PCT No.: PCT/US2014/032710
§ 371 (c)(1),
(2) Date: Oct. 2, 2015

(87) PCT Pub. No.: WO2014/165616
PCT Pub. Date: Oct. 9, 2014

(65) Prior Publication Data

US 2016/0060074 A1 Mar. 3, 2016

Related U.S. Application Data

(60) Provisional application No. 61/807,788, filed on Apr. 3, 2013.

(51) Int. Cl.
*B65H 59/38* (2006.01)
*B65H 63/04* (2006.01)

(52) U.S. Cl.
CPC ..... *B65H 59/388* (2013.01); *B65H 63/04* (2013.01); *B65H 2701/319* (2013.01)

(58) Field of Classification Search
CPC ..... B65H 59/388; B65H 63/04
See application file for complete search history.

(56) References Cited

U.S. PATENT DOCUMENTS 3,596,458 A * 8/1971 Nakano ..... D01H 1/00 139/420 R
4,744,227 A 5/1988 Whitener, Jr. et al.
(Continued)

FOREIGN PATENT DOCUMENTS

EP 0489307 A1 6/1992
WO 2007/000611 A1 1/2007
(Continued)

OTHER PUBLICATIONS

International Search Report and Written Opinion Received for PCT Application No. PCT/US2014/032710, dated Jul. 29, 2014, 9 pages.
(Continued)

*Primary Examiner* — Shaun R Hurley
(74) *Attorney, Agent, or Firm* — Bridget C. Sciamanna; Kathleen A. Tyrrell

(57) ABSTRACT

A method for unwinding yarn is provided that allows for maximizing the draft of the yarn, while monitoring tension. The method includes providing a yarn package including elastic yarn; choosing a selected draft for said elastic yarn; unwinding the elastic yarn from the yarn package from a driven roll to yarn processing equipment at the selected draft which is determined by a ratio of a speed of the yarn at the yarn processing equipment to a speed of the driven roll; measuring tension in the elastic yarn; and providing an alarm when said tension reaches a critical level.

10 Claims, 1 Drawing Sheet

(56) References Cited

U.S. PATENT DOCUMENTS

| | | | | |
|---|---|---|---|---|
| 5,768,873 | A * | 6/1998 | Stiller | B65H 69/00 57/22 |
| 6,079,656 | A | 6/2000 | Schmodde et al. | |
| 7,896,282 | B2 * | 3/2011 | Barea | B65H 51/30 242/418 |
| 2007/0152093 | A1 | 7/2007 | Hartzheim | |
| 2008/0210804 | A1 * | 9/2008 | Barea | B65H 51/30 242/416 |
| 2012/0144794 | A1 * | 6/2012 | Ke | D02G 1/02 57/90 |
| 2013/0056573 | A1 * | 3/2013 | Barea | B65H 51/30 242/420.5 |
| 2013/0247535 | A1 * | 9/2013 | Pardini | D01F 1/10 57/243 |
| 2014/0084101 | A1 * | 3/2014 | Barea | B65H 59/388 242/419 |

FOREIGN PATENT DOCUMENTS

| | | | |
|---|---|---|---|
| WO | 2007/006411 | A1 | 1/2007 |
| WO | 2014/165616 | A1 | 10/2014 |

OTHER PUBLICATIONS

International Preliminary Report on Patentability Report Received for PCT Patent Application No. PCT/US2014/032710, dated Oct. 15, 2016, 8 pages.

* cited by examiner

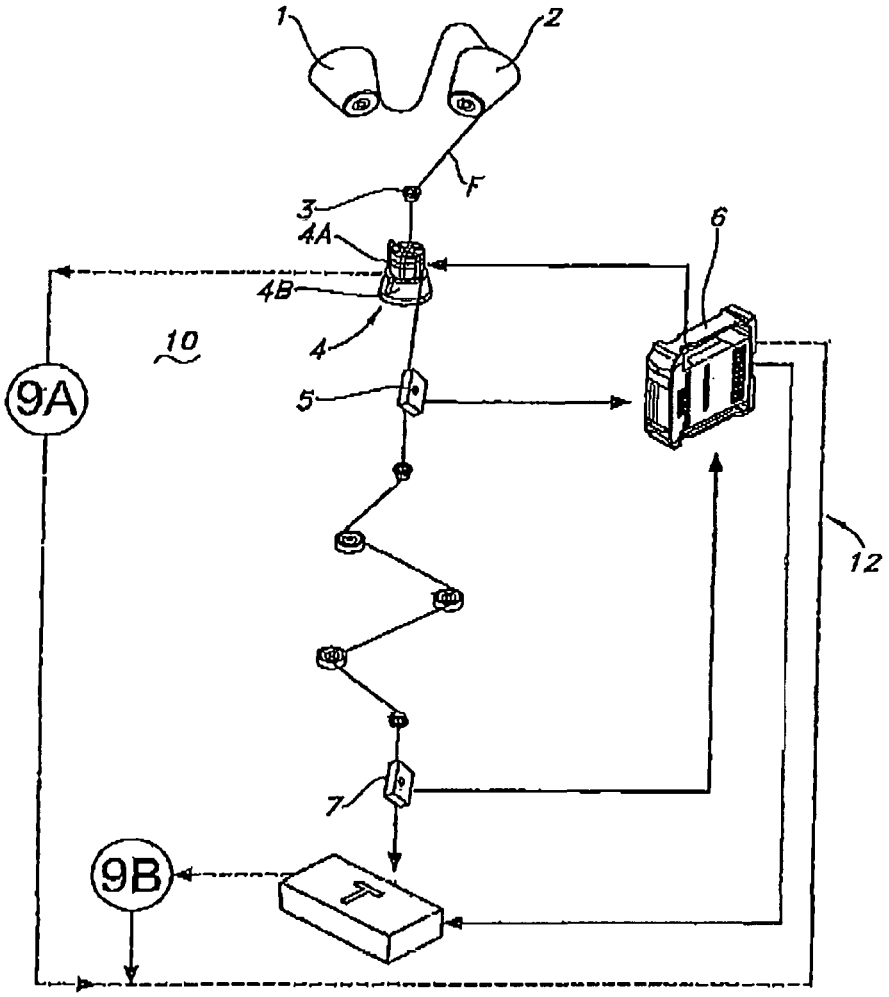
1
2
F
3
4A
4B
4
10
9A
5
6
12
7
9B

PROCESS FOR DRAFT CONTROL ON FEEDING OF ELASTIC YARN

BACKGROUND OF THE INVENTION

Field of the Invention

The invention relates to a method for maximizing utilization by controlling the draft of elastic yarn during incorporation of elastic yarn in production of a textile article.

Description of the Related Art

Textile articles, such as fabrics and nonwoven articles that include elastic yarns can be subject to variations in the product due to the inconsistent tension of the yarns as they are fed to the textile or yarn processing equipment. Several attempts have been made to provide textile articles of consistent quality by seeking to improve the consistency of tension of the yarns after then are unwound from the yarn package and fed to the yarn processing equipment.

For example, the concerns of variation in tension are addressed in U.S. Patent Application Publication No. 2007/0152093 A1 to Hartzheim ("Hartzheim"). Hartzheim solves this problem by introducing a tension control device which reduces the variation in yarn tension from the unwinding of the elastic yarn to the introduction of the yarn to the yarn processing equipment. This is accomplished by a single loop tension control system.

Another example of tension control is found in International Application WO 2007/00611 A1 to Barea ("Barea"). Barea also provides a solution to tension control in yarn processing that is improved by providing a double loop tension control device for providing a constant tension of the yarn.

SUMMARY OF THE INVENTION

Although tension control devices are useful for maintaining consistency in the tension of an elastic yarn, they do not accommodate for uses where a variation in tension can provide a commercially acceptable product. For certain textile products which may include fabrics or nonwovens such as hygiene articles and diapers, maximizing and maintaining consistent draft of the elastic fiber, which maximizes utilization and production is an equally and in some cases more important goal. There is a need for a method that achieves the goals of maximizing draft of the elastic yarn while also reducing or eliminating the down time of yarn processing equipment due to breaks caused by unacceptable spikes in yarn tension.

When the yarn is used at a chosen draft, the textile manufacturer has the ability to maximize yield for the textile product. This allows for the most efficient use of each yarn package. Accordingly, the draft of the yarn may be increased where the tension reaches an unacceptably low level.

The draft of elastic yarn can be maximized to increase productivity while monitoring and accommodating for tension spikes or where the tension in the yarn reaches a critical level by unwinding an elastic yarn from a yarn package for use in a yarn process including:

(a) providing an yarn package including elastic yarn;
(b) choosing a selected draft for the elastic yarn;
(c) unwinding said elastic yarn from the yarn package from a driven roll to yarn processing equipment at the selected draft which is determined by a ratio of a speed of the yarn at the yarn processing equipment to a speed of the driven roll;
(d) measuring tension in the elastic yarn;
(e) providing an alarm when the tension reaches a critical level.

The selected draft can be a desired maximum draft or other draft as needed for the desired product to be produced by the yarn processing equipment. The alarm can serve any of a number of purposes such as notifying an operator that a yarn break will likely occur, notifying an human operator that the yarn tension should be decreased, and/or providing a signal that will automatically adjust the yarn tension, among others.

BRIEF DESCRIPTION OF THE DRAWING

FIG. 1 is a schematic view of apparatus in accordance with the invention.

DETAILED DESCRIPTION OF THE INVENTION

A method for unwinding elastic yarn includes: (a) providing an yarn package including elastic yarn; (b) choosing a selected draft for said elastic yarn; (c) unwinding said elastic yarn from said yarn package from a driven roll to yarn processing equipment at said selected draft which is determined by a ratio of a speed of said yarn at the yarn processing equipment to a speed of the driven roll; (d) measuring tension in said elastic yarn; (e) providing an alarm when said tension reaches a critical level. This critical level could a critical high tension level or a critical low tension level.

This method for unwinding yarn for use in a yarn processing or textile manufacturing equipment is useful for a variety of different end uses or applications. One suitable unwinding method is known as over end unwinding, also referred to as over end take-off (OETO). In the over end take-off method, the package of thread is fixedly mounted on the unwind stand so that the axis of rotation of the package is pointed in the general direction of the path to be traversed by the thread as the thread is drawn from the package. However, in the over end take-off method, the package of thread does not rotate as the thread is being drawn from the package. Rather, the thread comes off the spool over the end of the spool. As the thread leaves the spool, the locus of departure rotates about the circumference of the spool, such that the path initially traversed by the thread is rotational in nature. At lower speeds, the thread gets just past the 12 o'clock position on the spool and drops to the 6 o'clock position. At higher speeds, the thread rotational action embodies centripetal forces which are acting essentially perpendicular to the general direction of travel of the thread, whereby the thread leaving the spool looks much like a loop, a jump rope, or hoop, or ballooning action. All such actions are intended to be included in referring to the action of the thread as a "loping" action. Such loping action must be controlled, damped out, so that the thread can be guided at controlled tension and direction along a predetermined path, in such a manner as to be delivered, fed, to the manufacturing process at a controlled and generally constant, though changeable, level of tension. In achieving the generally constant level of tension, the tension spikes and other tension variations, which are inherent in the over end dispensing of such a sticky thread, must be dissipated within the unwinding and feeding mechanism.

Since the spool is fixed in location, the operator can tie the trailing end of a first active spool to the leading end of a next-in-line reserve spool such that the tail end of an active spool automatically transfers the feed to the reserve spool when the active spool is exhausted, whereby there is no need to stop the manufacturing process to change spools. Accordingly, over end feeding inherently avoids the above noted wasting of thread on changed-out spools where the thread supply has not all been used up, as well as the shut-down, start-up times associated with such spool change-outs Thus, over end feeding embodies built-in cost savings related to both materials usage and production output, whereby over end unwinding is a desirable technology for unwinding tacky threads and feeding such tacky threads into a manufacturing process. Additives are also known to reduce the tackiness of the yarn. The yarn of some aspects may include an anti-tack additive.

The present invention will be more apparent from the accompanying drawing, which is provided by way of non-limiting example and in which the only FIGURE is a schematic view of the device of one embodiment.

With reference to said figure, a device of the invention is used to control the feed of a yarn F to a textile machine T, for example a diaper production machine, i.e. a textile machine in which each spool from which a corresponding yarn worked by said machine unwinds is positioned at a distance which can vary from one meter to several tens of meters. In the example, the yarn F unwinds from a spool 2 connected in known head-tail manner to another spool 1. This enables the yarn to be continuously processed by the textile machine, hence avoiding stoppage when the spool is empty. The yarn may be unwound by the over end takeoff method described above. After leaving the spool 2, the yarn F passes through a usual thread guide 3, which may be positioned in front of the two spools 1 and 2 such that both the axes of said spool coincide with the center of the thread guide to allow regular switch-over and unwinding of the two spools when the first is empty. After cooperating with the thread guide 3, the yarn F cooperates with the device 10 for measuring tension and adjusting yarn draft. This device 10, of known type, comprises in the example shown in the figure a driven roll 4 including a rotary element 4A on which the yarn F sides driven by its own electric motor 4B, for example of brushless type, and a usual tension sensor 5. These components 4 and 5 of the device 10 are connected to a control circuit or unit such as of microprocessor type 6 which, on the basis of tension data measured by the sensor 5 may provide an adjustment to the draft of the yarn. The yarn draft is calculated and may be controlled by the microprocessor 6, which is coupled with the rotary element speed signal 9A and the production line speed signal 9B A speed signal (9A) is taken from the rotary element motor (4B) and compared to a production line speed signal (9B). A control algorithm (control loop 12) sets the speed of rotary element motor (4B) to a predetermined setpoint that is typically a fraction of the production line speed. In this way the elongation of the elastic thread would be managed as the primary control loop.

Managing the elongation of the thread is the primary control allows garment/diaper producers to maximize the yield (minimize consumption) of the elastic thread. The setpoint and measurements of the tension control loops may be used to fine tune the primary yarn elongation control loop and raise alarms as desired to avoid production line downtime due to thread breaks.

When the microprocessor 6 senses an critical tension level, an alarm is triggered. This may be a visual alarm, an audible alarm, or a signal. Where the alarm provides a signal it may be to reduce the tension of the elastic yarn draft by increasing the speed of the driven roll. Alternatively, the draft may be reduced by reducing the speed of the yarn processing equipment.

An optional second sensor 7 may also be used as a replacement for the sensor 5 or in addition to sensor 5. When the second sensor 7 replaces the sensor 5, it provides the same function described above. When second sensor 7 is included in addition to sensor 5, it provides an additional point for sensing tension in the threadline, which is communicated to microprocessor 6 to provide an alarm or signal to adjust the draft of the yarn.

The elastic yarn may be any suitable elastic yarn such as spandex, lastol, or polyester bicomponent fiber, such as LYCRA® T400® fiber from INVISTA, Wichita, Kans.

The draft may be any suitable draft for yarn processing/manufacturing equipment. Examples include where the draft is about 1.5 to about 5.5, or about 2.5 to about 5, or about 3 to 4. The selected draft may be a maximum draft for the elastic yarn.

The critical high tension level signals that a yarn break may occur, which can result in down time for the yarn processing equipment. A critical high tension level is about 0.1 gmf/decitex or higher. A critical low tension level may be about 0.02 gmf/decitex.

The method of some embodiments may also include: (f) measuring said tension subsequent to reducing the draft; and (g) increasing the draft to the selected draft following a decrease in tension below said critical point.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. A method for unwinding an elastic yarn from a yarn package for use in a yarn process which maximizes and maintains a consistent selected draft of the elastic yarn, said method comprising:

(a) providing a yarn package including elastic yarn;

(b) choosing a selected draft for said elastic yarn;

(c) unwinding said elastic yarn from said yarn package from a driven roll to yarn processing equipment at said selected draft which is determined by a ratio of a speed of said yarn at the yarn processing equipment to a speed of the driven roll;

(d) measuring tension in said elastic yarn;

(e) providing an alarm when said tension reaches a critical high tension level or a critical low tension level; and (f) automatically adjusting draft when said tension reaches a critical high tension level or a critical low tension level.

2. The method of claim 1, wherein said draft is 1.5 to 5.5.

3. The method of claim 1, wherein said critical high tension level is 0.1 gmf/decitex or higher.

4. The method of claim 1, wherein said critical low tension level is 0.02 gmf/decitex.

5. The method of claim 1, wherein said alarm is an audible alarm.

6. The method of claim 1, wherein said alarm provides a signal to reduce the tension of the elastic yarn draft by increasing the speed of the driven roll.

7. The method of claim 1, wherein said draft is reduced by reducing the speed of said yarn processing equipment.

8. The method of claim 1, further comprising:

(g) measuring said tension subsequent to adjusting said draft; and (h) increasing the draft to said selected draft following a decrease in tension below said critical point.

9. The method of claim 1, wherein said elastic yarn includes an anti-tack additive.

10. The method of claim 1, wherein said alarm alerts a human operator that said elastic yarn may break.

* * * * *